US006323587B1

(12) United States Patent
Zhang et al.

(10) Patent No.: US 6,323,587 B1
(45) Date of Patent: Nov. 27, 2001

(54) TITANIUM SILICIDE NITRIDE EMITTERS AND METHOD

(75) Inventors: Tianhong Zhang; John K. Lee; Behnam Moradi, all of Boise, ID (US)

(73) Assignee: Micron Technology, Inc., Boise, ID (US)

( * ) Notice: Subject to any disclaimer, the term of this patent is extended or adjusted under 35 U.S.C. 154(b) by 0 days.

(21) Appl. No.: 09/130,634

(22) Filed: Aug. 6, 1998

(51) Int. Cl.[7] ..... H01J 1/30

(52) U.S. Cl. ..... 313/309; 313/310; 313/336; 313/351; 313/495; 313/311

(58) Field of Search ..... 313/309, 311, 313/336, 351, 495, 497, 310

(56) References Cited

U.S. PATENT DOCUMENTS

| | | | | |
|---|---|---|---|---|
| 5,229,682 | * | 7/1993 | Komatsu | 313/336 X |
| 5,401,676 | | 3/1995 | Lee | 437/200 |
| 6,008,063 | * | 12/1999 | Derraa | 313/336 X |
| 6,028,322 | * | 2/2000 | Moradi | 313/336 X |

OTHER PUBLICATIONS

Michiaki Endo et al., "Fabriction of transition metal nitride field emitters," *Applied Surface Science,* 94/95:113–116, 1996.

Chalamala, Babu R. and Bruce E. Gnade, "Fed Up With Fat Tubes," *IEEE Spectrum,* Apr. 1998, pp. 42–51.

Eung Joon Chi et al., "Electrical Characteristics of Metal Silicide Field Emitters," 9$^{th}$ International Vacuum Microelectronics Conference, St. Petersburg, 1996, pp. 188–191.

Masayuki Nakamoto et al., "Low Operation Voltage Field Emitter Arrays Using Low Work Function Materials Fabricated by Transfer Mold Technique," *EEDM,* pp. 297–300, 1996.

Yukihiro Morimoto et al., "Analysis of Gas Release From Vitreous Silica," *Journal on Non–Crystalline Solids,* 139:35–46, 1992.

* cited by examiner

*Primary Examiner*—Ashok Patel
(74) *Attorney, Agent, or Firm*—Dorsey & Whitney LLP

(57) ABSTRACT

A field emission display apparatus includes a plurality of emitters formed on a substrate. Each of the emitters includes a titanium silicide nitride outer layer so that the emitters are less susceptible to degradation. A dielectric layer is formed on the substrate and the emitters, and an opening is formed in the dielectric layer surrounding each of the emitters. A conductive extraction grid is formed on the dielectric layer substantially in a plane defined by the emitters, and includes an opening surrounding each of the emitters. A cathodoluminescent faceplate having a planar surface is disposed parallel to the substrate.

13 Claims, 5 Drawing Sheets

TITANIUM SILICIDE NITRIDE EMITTERS AND METHOD

GOVERNMENT RIGHTS

This invention was made with government support under Contract No. DABT63-93-C-0025 awarded by Advanced Research Projects Agency (ARPA). The government has certain rights in this invention.

TECHNICAL FIELD

This invention relates in general to visual displays for electronic devices and more particularly to improved emitters for field emission displays.

BACKGROUND OF THE INVENTION

FIG. 1 is a simplified side cross-sectional view of a portion of a field emission display 10 including a faceplate 20 and a baseplate 21 in accordance with the prior art. FIG. 1 is not drawn to scale. The faceplate 20 includes a transparent viewing screen 22, a transparent conductive layer 24 and a cathodoluminescent layer 26. The transparent viewing screen 22 supports the layers 24 and 26, acts as a viewing surface and as a wall for a hermetically sealed package formed between the viewing screen 22 and the baseplate 21. The viewing screen 22 may be formed from glass. The transparent conductive layer 24 may be formed from indium tin oxide. The cathodoluminescent layer 26 may be segmented into pixels yielding different colors for color displays. Materials useful as cathodoluminescent materials in the cathodoluminescent layer 26 include $Y_2O_3$:Eu (red, phosphor P-56), $Y_3(Al, Ga)_5O_{12}$:Tb (green, phosphor P-53) and $Y_2(SiO_5)$:Ce (blue, phosphor P-47) available from Osram Sylvania of Towanda Pa. or from Nichia of Japan.

The baseplate 21 includes emitters 30 formed on a planar surface of a substrate 32. The substrate 32 is coated with a dielectric layer 34. In one embodiment, this is effected by deposition of silicon dioxide via a conventional TEOS process. The dielectric layer 34 is formed to have a thickness that is less than a height of the emitters 30. This thickness is on the order of 0.4 microns, although greater or lesser thicknesses may be employed. A conductive extraction grid 38 is formed on the dielectric layer 34. The extraction grid 38 may be formed, for example, as a thin layer of doped polysilicon. The radius of an opening 40 created in the extraction grid 38, which is also approximately the separation of the extraction grid 38 from the tip of the emitter 30, is about 0.4 microns, although larger or smaller openings 40 may also be employed.

The baseplate 21 also includes a field effect transistor ("FET") 50 formed in the surface of the substrate 32 for controlling the supply of electrons to the emitter 30. The FET 50 includes an n-tank 52 formed in the surface of the substrate 32 beneath the emitter 30. The n-tank 52 serves as a drain for the FET 50 and may be formed via conventional masking and ion implantation processes. The FET 50 also includes a source 54 and a gate electrode 56. The gate electrode 56 is separated from the substrate 32 by a gate oxide 57 and a field oxide layer 58. The emitter 30 is typically about a micron tall, and several emitters 30 are generally included together with each n-tank 52, although only one emitter 30 is illustrated.

The substrate 32 may be formed from p-type silicon material having an acceptor concentration $N_A$ ca. $1–5\times10^{15}/cm^3$, while the n-tank 52 may have a surface donor concentration $N_D$ ca. $1–2\times10^{16}/cm^3$.

In operation, the extraction grid 38 is biased to a voltage on the order of 40–80 volts, although higher or lower voltages may be used, while the substrate 32 is maintained at a voltage of about zero volts. Signals coupled to the gate 56 of the FET 50 turn the FET 50 on, allowing electrons to flow from the source 54 to the n-tank 52 and thus to the emitter 30. Intense electrical fields between the emitter 30 and the extraction grid 38 then cause field emission of electrons from the emitter 30. A larger positive voltage, ranging up to as much as 5,000 volts or more but often 2,500 volts or less, is applied to the faceplate 20 via the transparent conductive layer 24. The electrons emitted from the emitter 30 are accelerated to the faceplate 20 by this voltage and strike the cathodoluminescent layer 26. This causes light emission in selected areas, ie., those areas adjacent to where the FETs 50 are conducting, and forms luminous images such as text, pictures and the like. Integrating the FETs 50 in the substrate 32 to provide an active display 10 (i.e., a display 10 including active circuitry for addressing and providing control signals to specific emitters 30, etc.) yields advantages in size, simplicity and ease of interconnection of the display 10 to other electronic componentry.

When the emitted electrons strike the cathodoluminescent layer 26, compounds in the cathodoluminescent layer 26 dissociate. This causes outgassing of materials from the cathodoluminescent layer 26. When the outgassed materials react with the emitters 30, a barrier height of the emitters 30 may increase. When the emitter barrier height increases, the emitted current is reduced. This reduces the luminance of the display 10.

Residual gas analysis indicates that the dominant materials outgassed from some display cathodoluminescent layers 26 include oxygen and hydroxyl radicals. This leads to oxidation of the emitters 30 and especially emitters 30 formed from silicon. Silicon emitters 30 are useful because they are readily formed and integrated with other electronic devices on silicon substrates. Electron emission is reduced when silicon emitters 30 oxidize. This degrades performance of the display 10.

Therefore there is a need for a way to prevent degradation, and especially oxidation, of emitters 30 used in displays 10.

SUMMARY OF THE INVENTION

In accordance with an aspect of the invention, a field emission display has a plurality of emitters including titanium silicide nitride. The plurality of emitters is formed on a substrate that is part of a baseplate. A dielectric layer is formed on the substrate, a semiconductor device formed in or on the substrate for controlling the flow of electrons to the emitters, and the plurality of emitters. The display includes an extraction grid formed in a plane defined by tips of the plurality of emitters. The extraction grid includes an opening surrounding and in close proximity to each tip of the plurality of emitters. Significantly, the tips include titanium silicide nitride.

As a result, the emitters are markedly more resistant to reaction with compounds released from the cathodoluminescent layer by electron bombardment than are silicon emitters. This results in a robust display that resists emitter degradation the emitters may also exhibit increased emissivity due to reduced work function provided by titanium silicide nitride compared to the work function of silicon.

DETAILED DESCRIPTION OF THE INVENTION

Figure 1:
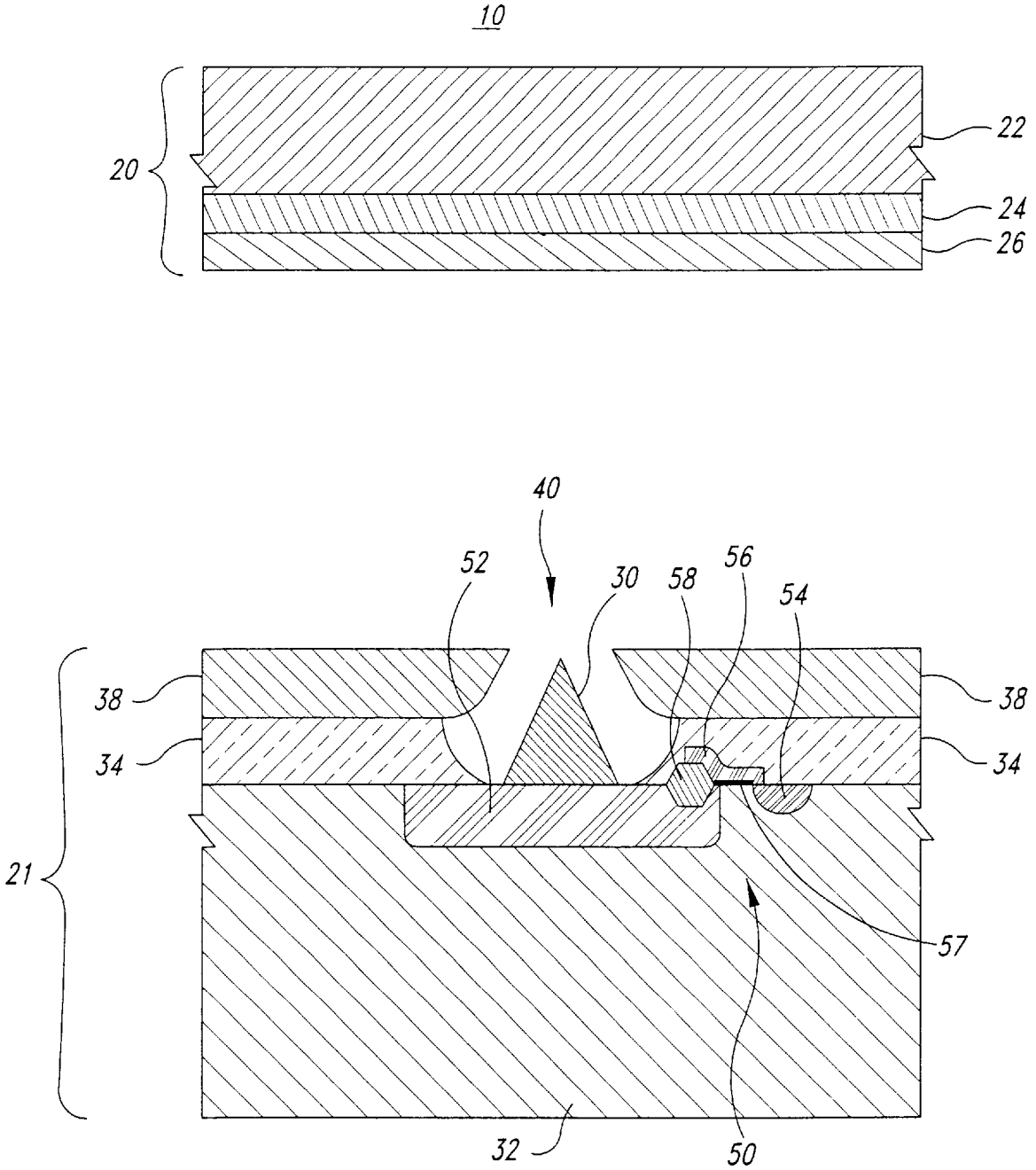
Fig. 1 (PRIOR ART)
FIG. 1 is a simplified side cross-sectional view of a portion of a display including a faceplate and a baseplate in accordance with the prior art.
Figure 2:
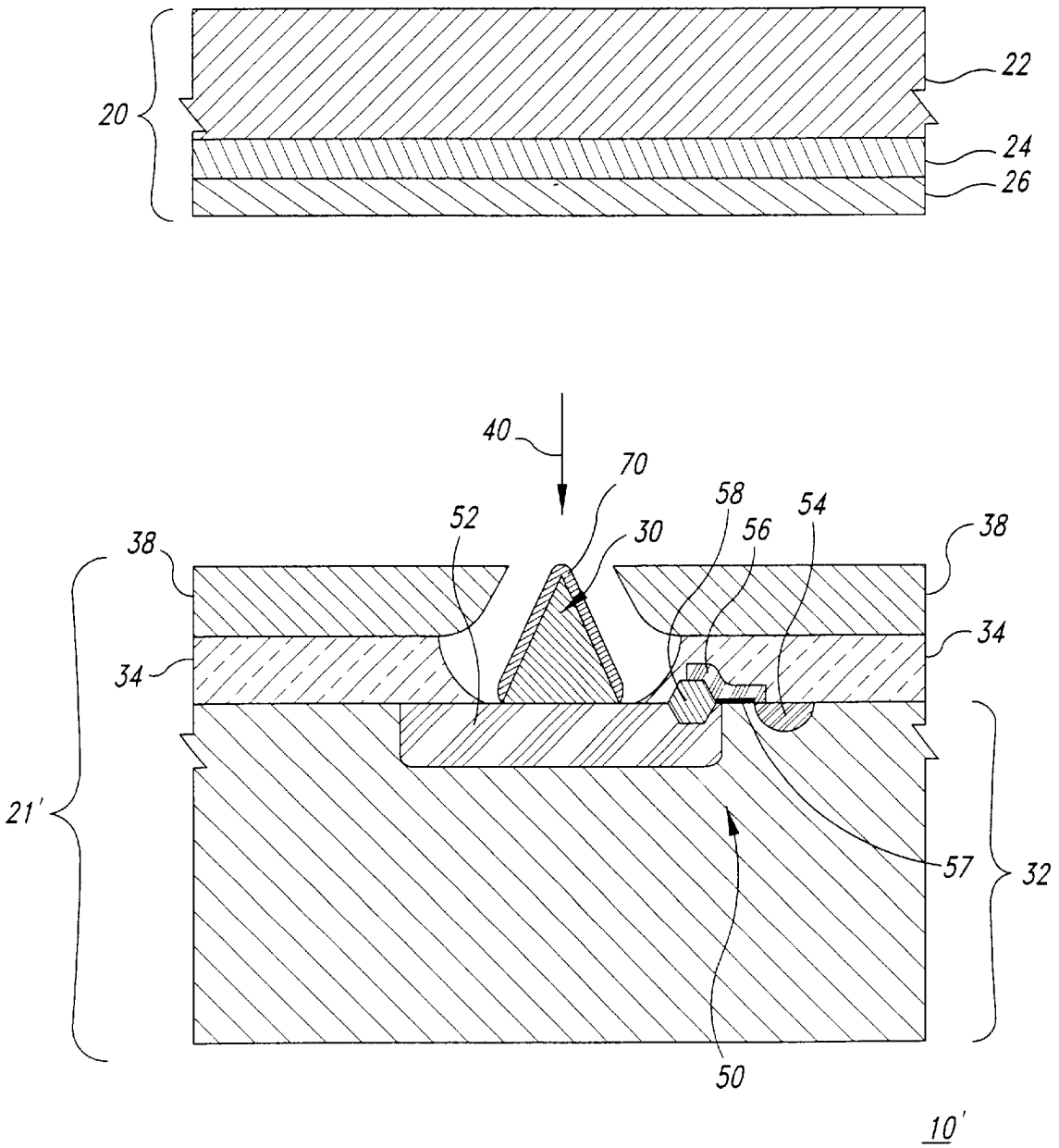
FIG. 2 is a simplified side cross-sectional view of a portion of a display according to an embodiment of the present invention.

FIG. 2 is a simplified side cross-sectional view of a portion of a field emission display 10' in accordance with one embodiment of the present invention. FIG. 2 is not drawn to scale. Many of the components used in the display 10' shown in FIG. 2 are identical to components used in the display 10 of FIG. 1. Therefore, in the interest of brevity, these components have been provided with the same reference numerals, and an explanation of them will not be repeated.

It has been discovered that coating at least the tips of the emitters 30 with a titanium silicide nitride layer 70 provides significant advantages when the emitter 30 is used in the display 10'. In one embodiment, the advantages include improved resistance to chemical poisoning of the emitters 30 from materials that are outgassed from the cathodoluminescent layer 26 in response to electron bombardment. This provides improved lifetime for the emitter 30 and therefore for the display 10' incorporating the emitter 30. Coating at least tips of the emitters 30 with the titanium silicide nitride layer 70 also provides a decreased work function compared to silicon emitters 30, resulting in increased current from each emitter 30 together with reduced turn-on voltage.

Figure 3:
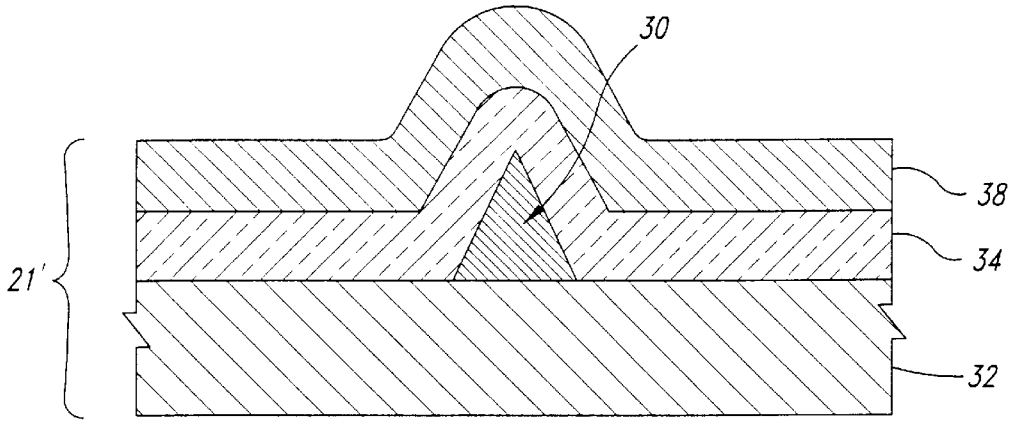
FIG. 3 is a simplified side cross-sectional view of a portion of a baseplate for the display at one stage in manufacturing according to an embodiment of the present invention.

FIGS. 3 through 6 illustrate a portion of the baseplate 21' for the display 10' of FIG. 2 at various stages in manufacturing according to an embodiment of the present invention. As shown in FIG. 3, an emitter 30 has been fabricated on the substrate 32, and the substrate 32 and the emitters 30 are coated with the dielectric layer 34. An extraction grid 38 including a conductive layer is then formed on the dielectric layer 34. The extraction grid 38 may be formed, for example, as a thin layer of doped polysilicon, however, other materials can be employed.

Figure 4:
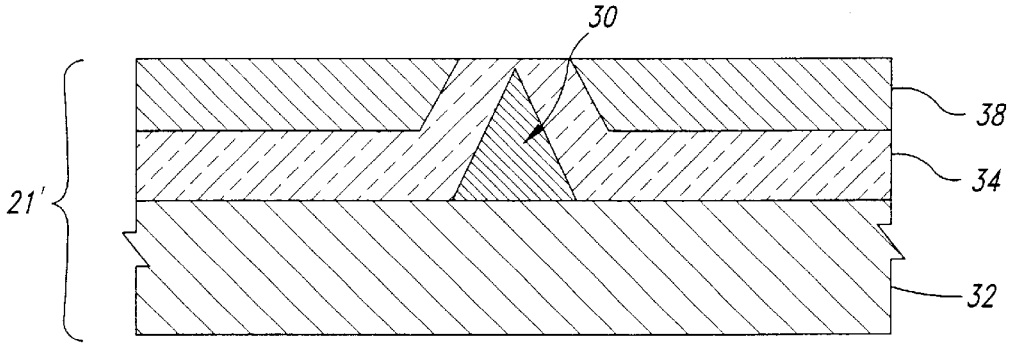
FIG. 4 is a simplified side cross-sectional view of a portion of a baseplate for the display at a later stage in manufacturing according to an embodiment of the present invention.

As shown in FIG. 4, a conventional chemical-mechanical polish is carried out to remove the "hill" of dielectric material 34 and extraction grid 38 immediately above the tip of the emitter 30. This is typically carried out via a potassium hydroxide solution that incorporates suspended particles of controlled size, which may be silicon particles. It is important that this chemical-mechanical polish not damage the tips of the emitters 30, i.e., that the polishing process stops short of reaching these tips.

Figure 5:
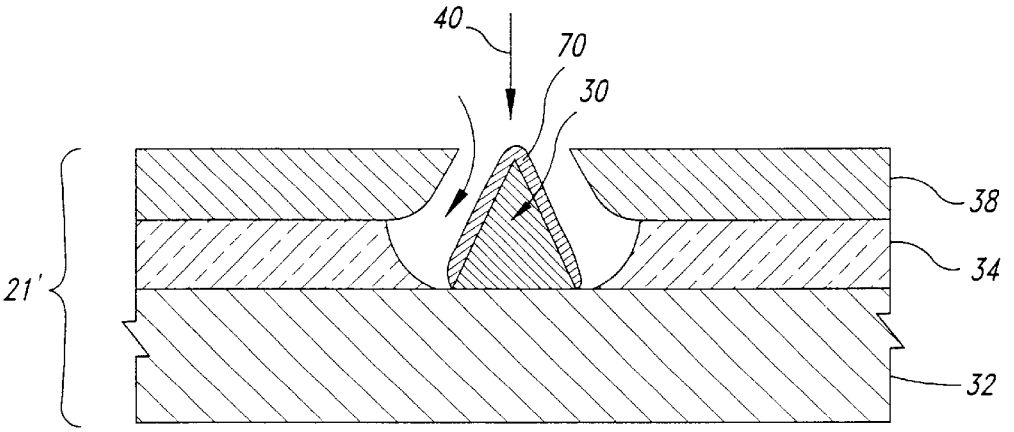
FIG. 5 is a simplified side cross-sectional view of a portion of a baseplate for the display at a still later stage in manufacturing according to an embodiment of the present invention.

With reference to FIG. 5, following the chemical-mechanical polishing operation, the extraction grid 38 is used as a mask for etching the dielectric layer 34 to expose at least the tips of the emitters 30 in the openings 40. This has the advantage of not requiring a separate photoresist application, exposure and development, thus reducing labor content and materials requirements. This also promotes increased yields by reducing the number of processing steps. When silicon dioxide is used to form the dielectric layer 34, this step may be carried out by etching the wafer in a conventional buffered aqueous hydrogen fluoride oxide etch or BOE.

As also shown in FIG. 5, following etching of the dielectric layer 34 to expose at least the tip of the emitter 30, a titanium silicide nitride layer 70 is formed on the emitter 30 by a process explained below with reference to FIG. 6.

Figure 6:
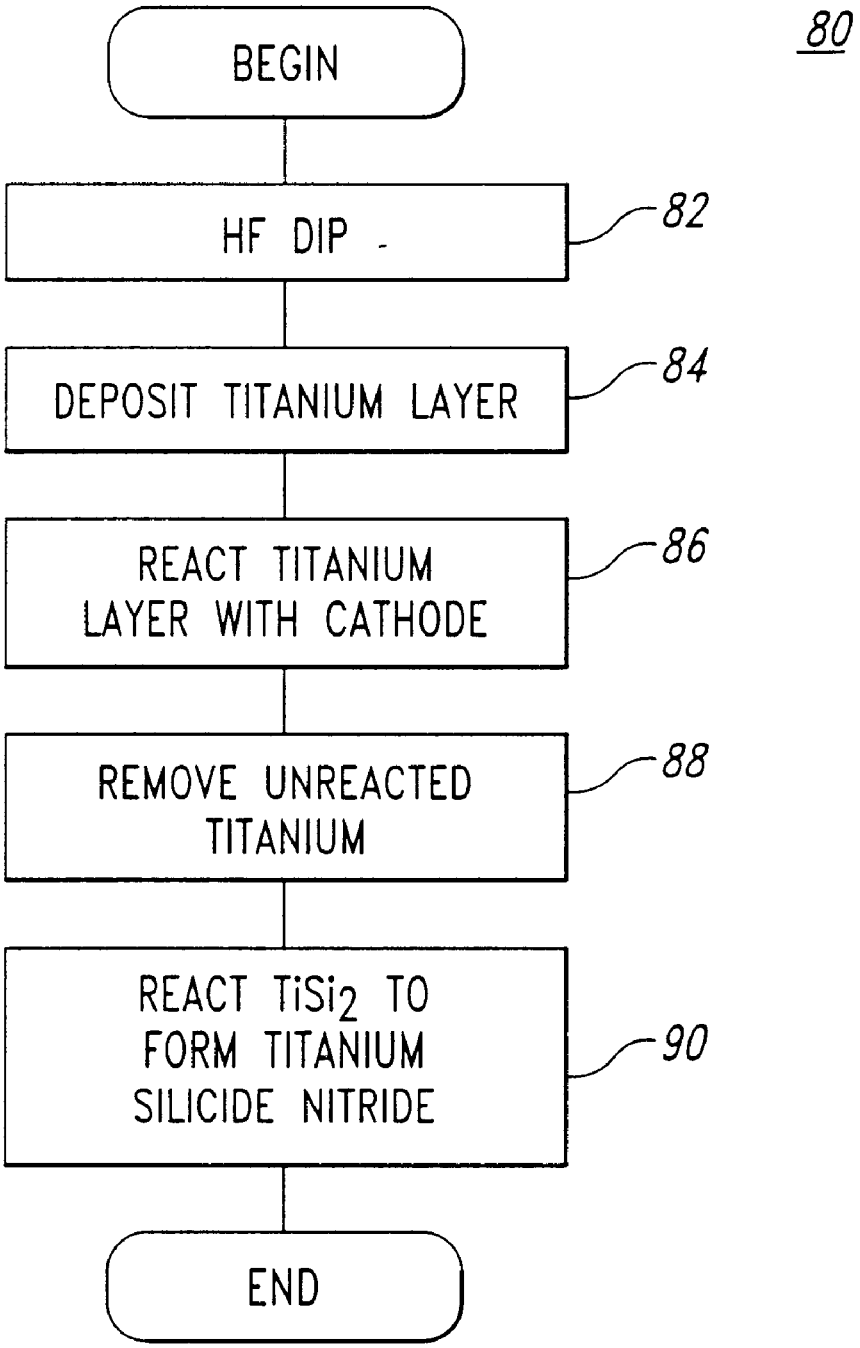
FIG. 6 is a flow chart of a process for manufacturing a baseplate for the display according to an embodiment of the present invention.

FIG. 6 is a flow chart of a process 80 for manufacturing emitters 30 according to an embodiment of the present invention. The substrate 32 having a plurality of the emitters 30 has been previously formed, and the surface of the substrate 32 and the emitters 30 have been previously coated with the dielectric layer 34. The extraction grid 38 has been previously deposited, and the chemical-mechanical polish and etch have been previously carried out to expose at least the tips of the emitters 30. Optional step 82 removes any native oxide from the emitters 30, via, e.g., a conventional hydrogen fluoride etching step. Other methods for removal of native oxide are also suitable for use with the present invention, provided that the oxide removal process does not blunt the tips of the emitters 30.

In step 84, a layer of titanium is formed over the surface of the extraction grid 38 and also over at least the tips of the emitters 30. The layer of titanium may be applied in any of several ways, including evaporation, chemical vapor deposition and the like, however, sputtering is preferred. The layer of titanium should not be so thick as to distort the tips of the emitters 30 and should be thick enough to ensure coating of the tips, i.e., to obviate formation of pinholes in the titanium layer. In one embodiment, the titanium layer is on the order of five hundred angstroms thick.

The titanium layer is then reacted in step 86 with the silicon forming the emitter 30 to form titanium silicide or $TiSi_2$. This may be realized by rapid thermal annealing of the emitters 30 and the titanium layer, for example, at 670° C. for 30 seconds in nitrogen. Unreacted titanium may then be removed in optional step 88 by conventional etching, for example, with $NH_4OH:H_2O_2:H_2O=1:1:5$.

The titanium silicide is then reacted with nitrogen to form the titanium silicide nitride layer 70 (FIG. 5) in step 90. This may be effected by rapid thermal annealing at a suitable temperature, such as 1050° C., in ammonia for a suitable period, such as 90 seconds. The process 80 then ends and other conventional processing steps for forming field emission displays 10' are carried out.

It will be understood that while rapid thermal annealing is employed in one embodiment, other forms of heat treatment may be used to react the titanium to form titanium silicide and to react the titanium silicide to form titanium silicide nitride. For example, titanium and silicon may be reacted by heating in an oven at 700° C. for half an hour. It will also be understood that emitters 30 including titanium silicide nitride may be made via other processes.

The process 80 illustrated via FIG. 6 results in an emitter body 30 that is coated with a titanium silicide nitride layer 70. This provides several advantages. The titanium silicide nitride layer 70 that is formed resists attack by BOE, which is useful in subsequent processing steps when BOE is used to pattern subsequent layers. Measurements of the titanium silicide nitride layers 70 formed by the process 80 provide sheet resistivities on the order of 3.4 ohms per square.

Emitters 30 having a titanium silicide nitride surface layer 70 thus provide lower turn-on voltages and higher currents compared with silicon. Moreover, titanium silicide nitride is very resistant to oxidation, especially when compared to silicon, leading to improved performance and a more robust emitter 30. However, it will be understood that the emitter 30 may be coated with a work function decreasing layer formed by other materials. Additionally, forming the layer 70 from a layer that is metallurgically alloyed to the emitter 30 provides a robust emitter 30 having reproducible characteristics.

The process 80 does not require any photolithographic steps and therefore has minimal impact on labor content and materials requirements. The process 80 is also consistent with increased yields due to simplification of device processing. It is completely self aligned, promoting higher yields by avoiding some error sources.

Figure 7:
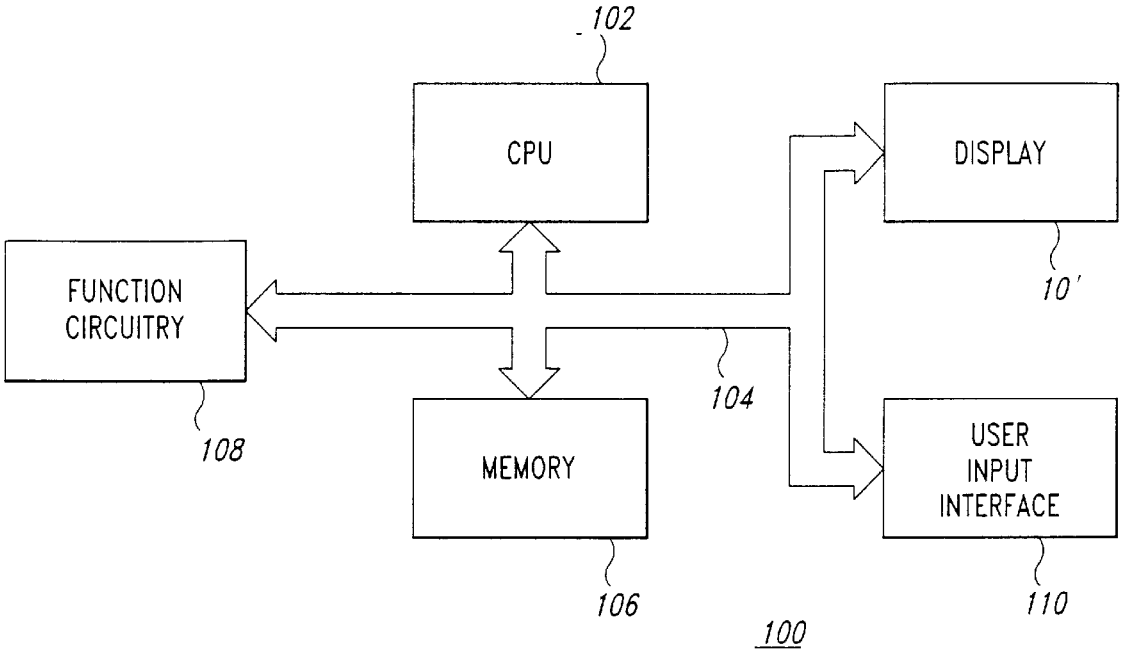
FIG. 7 is a simplified block diagram of a computer using the emitter according to an embodiment of the present invention.

FIG. 7 is a simplified block diagram of a portion of a computer 100 using the display 10' fabricated as described with reference to FIGS. 2 through 6 and associated text. The computer 100 includes a central processing unit 102 coupled via a bus 104 to a memory 106, function circuitry 108, a user input interface 110 and the display 10' including the emitters 30 having the titanium silicide nitride layer 70 according to the embodiments of the present invention. The memory 106 may or may not include a memory management module (not illustrated) and does include ROM for storing instructions providing an operating system and a read-write memory for temporary storage of data. The processor 102 operates on data from the memory 106 in response to input data from the user input interface 110 and displays results on the display 10'. The processor 102 also stores data in the read-write portion of the memory 106. Examples of systems where the computer 100 finds application include personal/portable computers, camcorders, televisions, automobile electronic systems, microwave ovens and other home and industrial appliances.

Field emission displays 10' for such applications provide significant advantages over other types of displays, including reduced power consumption, improved range of viewing angles, better performance over a wider range of ambient lighting conditions and temperatures and higher speed with which the display can respond. Field emission displays 10' find application in most devices where, for example, liquid crystal displays find application.

Although the present invention has been described with reference to specific embodiments, the invention is not limited to these embodiments. Rather, the invention is limited only by the appended claims, which include within their scope all equivalent devices or methods which operate according to the principles of the invention as described.

What is claimed is:

1. A field emission display baseplate, comprising:

a substrate;

a plurality of emitters formed on the substrate; and a layer of material comprised of titanium silicide nitride, the layer of material decreasing a work function of the emitters formed on at least a portion of each of the emitters, and providing oxidation resistance and resisting etching by BOE or HF.

2. The baseplate of claim 1, further comprising:

a dielectric layer formed on the substrate, the dielectric layer including an opening surrounding each of the plurality of emitters; and a conductive extraction grid formed on the dielectric layer, the extraction grid substantially in a plane defined by tips of the plurality of emitters and including an opening surrounding each of the plurality of emitters.

3. A field emission display baseplate, comprising:

a substrate;

a plurality of emitters formed on the substrate;

a layer of titanium silicide nitride formed on each of the emitters;

dielectric means formed on the substrate, the dielectric means including an opening surrounding each of the plurality of emitters; and extraction grid means including conductive material formed on the dielectric means, the extraction grid means substantially in a plane defined by tips of the plurality of emitters and including an opening surrounding each of the plurality of emitters.

4. The baseplate of claim 3 wherein the emitters are formed from silicon.

5. The apparatus of claim 3 wherein the dielectric means comprises silicon dioxide.

6. The apparatus of claim 3 wherein the extraction grid means comprises a layer of doped polysilicon.

7. A field emission display baseplate, comprising:

a substrate; and a plurality of emitters formed on the substrate, each emitter having a titanium silicide nitride layer disposed thereon, the emitters having a work function below that of silicon and providing oxidation resistance and resisting etching by BOE or HF.

8. The baseplate of claim 7, further comprising:

a dielectric layer formed on the substrate and the plurality of emitters; and an extraction grid formed on the dielectric layer, the extraction grid including an opening surrounding each of the plurality of emitters.

9. The baseplate of claim 7 wherein the titanium silicide nitride layer has a thickness of about two hundred angstroms.

10. The baseplate of claim 7 wherein the substrate comprises p-type silicon.

11. The baseplate of claim 10, further including a FET comprising:

a n-tank disposed beneath one or more of the plurality of emitters, the n-tank forming a drain for the FET;

a field oxide formed at an edge of the n-tank;

a gate oxide extending from the field oxide onto the substrate;

a gate electrode formed on the field oxide and gate oxide; and a source electrode formed at an edge of the gate oxide remote from the n-tank.

12. A computer system comprising:

a central processing unit;

a memory device coupled to the central processing unit, the memory device storing instructions and data for use by the central processing unit;

an input device; and a display, the display including:

a cathodoluminescent coated faceplate having a planar surface;

a plurality of emitters formed on a surface of a substrate, each of the emitters having an outer surface formed by a layer of titanium silicide nitride;

a dielectric layer formed on the substrate, the dielectric layer including an opening surrounding each of the emitters; and a conductive extraction grid formed on the dielectric layer, the extraction grid substantially in a plane defined by tips of the plurality of emitters and including an opening surrounding each of the emitters.

13. The computer system of claim 12 wherein each of the emitters is coupled to a drain of a drive field effect transistor.

* * * * *